US006961962B1

(12) United States Patent
Lewis

(10) Patent No.: US 6,961,962 B1
(45) Date of Patent: Nov. 8, 2005

(54) COMBINED CLOSURE AND LINER ZIPPERS EMPLOYING COMMON ZIPPER TAPES AND PROTECTIVE GARMENT EMPLOYING SAID COMBINED ZIPPERS

(75) Inventor: Patricia Lewis, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/937,021

(22) Filed: Sep. 9, 2004

(51) Int. Cl.[7] ..... A41D 13/00
(52) U.S. Cl. ..... 2/97; 2/81
(58) Field of Search ..... 2/456, 457, 458, 2/49.4, 49.5, 69, 81, 93, 97, 102, 108, 70, 2/904, 915, 272, 164, 126, DIG. 2

(56) References Cited

U.S. PATENT DOCUMENTS 4,768,233 A * 9/1988 Grilliot et al. ..... 2/81
6,339,843 B1 * 1/2002 Grilliot et al. ..... 2/97
6,691,317 B2 * 2/2004 Cochran ..... 2/97

* cited by examiner

*Primary Examiner*—Tejash Patel

(74) *Attorney, Agent, or Firm*—Wood, Phillips, Katz, Clark & Mortimer

(57) ABSTRACT

A protective garment, such as a firefighter's coat, comprises an outer shell, an inner liner, a closure zipper for opening and closing the outer shell, and two liner zippers, each on one side of the closure zipper, for attaching and detaching the inner liner. Each zipper has two rows of interengageable teeth. Each row of interengageable teeth of the closure zipper and one of the rows of interengageable teeth of one of the liner zippers are provided along opposite edges of a common, fabric tape, which is sewn to and within the outer shell. The other row of interengageable teeth of each of the liner zippers is attached to one edge of a separate, fabric tape, which is sewn to the inner liner.

6 Claims, 1 Drawing Sheet

COMBINED CLOSURE AND LINER ZIPPERS EMPLOYING COMMON ZIPPER TAPES AND PROTECTIVE GARMENT EMPLOYING SAID COMBINED ZIPPERS

TECHNICAL FIELD OF THE INVENTION

This invention pertains to a closure zipper, which is useful for opening and closing an outer shell of a protective garment, and to two liner zippers, which are useful each on one side of the closure zipper for attaching and detaching an inner liner for the protective garment. Each zipper is of a type having two rows of interengageable teeth. This invention also pertains to a protective garment, such as a firefighter's coat, which employs such closure and liner zippers.

BACKGROUND OF THE INVENTION

Commonly, a protective garment, such as a firefighter's coat, has a closure zipper, which is used for opening and closing an outer shell of the protective garment, and two liner zippers, which are used, each on one side of the closure zipper, for attaching and detaching an inner liner for the protective garment. Commonly, in such a garment, each zipper is of a type having two rows of interengageable teeth and each row of interengageable teeth is provided along to one edge of a separate, fabric tape, which is sewn to the outer shell or to the inner liner.

Consequently, such a garment requires six fabric tapes, three tapes on each side from a wearer's standpoint, each tape having one row of interengageable teeth provided along one edge of said tape. If the protective garment is a firefighter's coat, each tape presents a sewn seam, which may have to be sealed so as to be water-tight.

SUMMARY OF THE INVENTION

This invention provides a combination comprising a closure zipper, which is useful for opening and closing an outer shell of a protective garment, such as a firefighter's coat, and two liner zippers, which are useful, each on one side of the closure zipper, for attaching and detaching an inner liner for the protective garment. Each zipper has two rows of interengageable teeth.

On each side of the closure zipper, a common, fabric tape having two opposite edges is provided, which is adapted to be attached, as by being sewn, to and within the outer shell, and each row of interengageable teeth of the closure zipper and one of the rows of interengageable teeth of one of the liner zippers are provided along opposite edges of the common, fabric tape, and the other row of interengageable teeth of each of the liner zippers is provided along to one edge of a separate, fabric tape, which is adapted to be attached, as by being sewn, to the inner liner.

This invention also provides a protective garment, such as a firefighter's coat, which comprises an outer shell, an inner liner, a closure zipper, as described above, and two liner zippers, as described above.

DETAILED DESCRIPTION OF THE ILLUSTRATED EMBODIMENT

Figure 1:
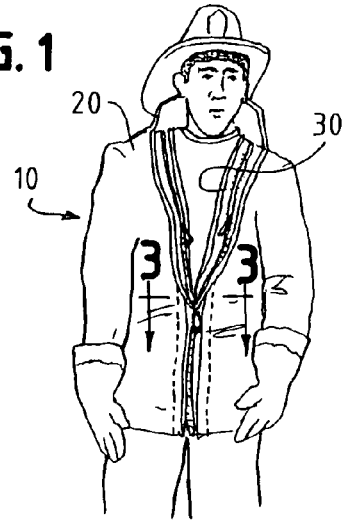
FIG. 1 is a fragmentary, pictorial, front view of a firefighter wearing a firefighter's coat, which comprises an outer shell, an inner liner, a closure zipper, as described above, and two liner zippers, as described above.
Figure 2:
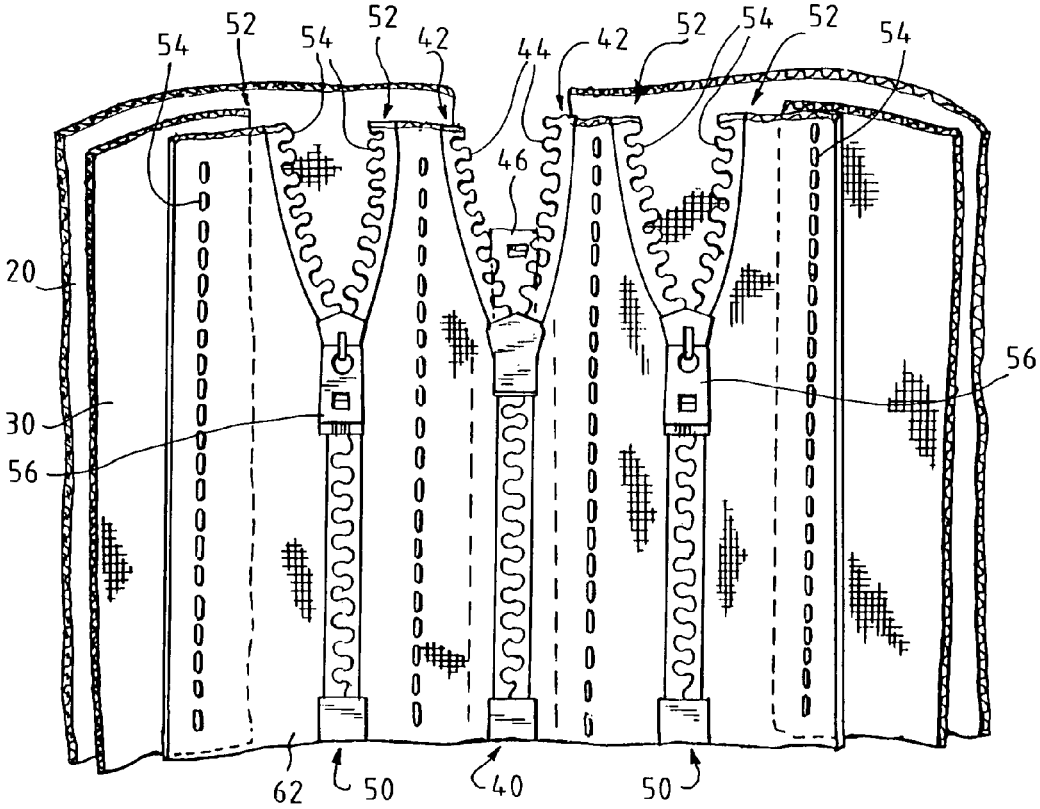
FIG. 2, on a larger scale, is a fragmentary detail taken from within the firefighter's coat.

As illustrated, a firefighter's coat 10, which exemplifies a protective garment provided by this invention, comprises an outer shell 20, an inner liner 30, a closure zipper 40 for opening and closing the outer shell 20, and two liner zippers 50, each on one side of the closure zipper 40, for attaching and detaching the inner liner 30. Except as illustrated and described herein, the closure zipper 40 and the liner zippers 50 are conventional and function conventionally.

Figure 3:
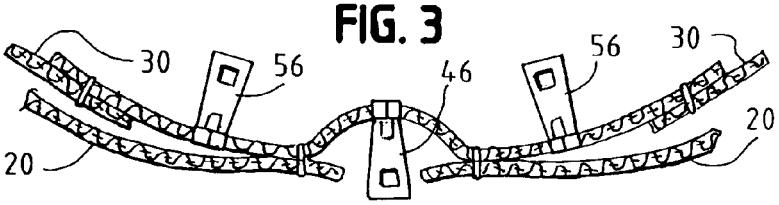
FIG. 3, on a similar scale, is a fragmentary, sectional view taken along line 3—3 in FIG. 1, in a direction indicated by arrows.

Thus, the closure zipper 40 has two rows 42 of interengageable teeth 44 and a slider 46, which is adapted to engage the rows 42 of interengageable teeth 44 when the slider 46 is drawn upwardly and which is adapted to disengage the rows 42 of interengageable teeth 44 when the slider 46 is drawn downwardly. Also, each liner zipper 50 has two rows 52 of interengageable teeth 54 a slider 56, which is adapted to engage the rows 52 of interengageable teeth 54 of said liner zipper 50 when the slider 56 is drawn upwardly and which is adapted to disengage the rows 52 of interengageable teeth 54 of said liner zipper 50 when the slider 56 is drawn downwardly. As illustrated in FIG. 3, the slider 46 for the closure zipper 40 is oriented so as to be operable from outside the firefighter's coat 10, while the sliders 56 for the liner zippers 50 are oriented so as to be operable from inside the firefighter's coat 10.

As contemplated by this invention, on each side of the closure zipper 40, one of the rows 42 of interengageable teeth 44 of the closure zipper 40 and one of the rows 52 of interengageable teeth 54 of one of the liner zippers 50 are provided along the opposite edges 62 of a common, fabric tape 60, which is attached by being sewn to and within the outer shell 20. Moreover, on each side of the closure zipper 40, the other row 52 of interengageable teeth 54 of each of the liner zippers 50 is provided along one edge 72 of a separate, fabric tape 70, which is attached by being sewn to the inner liner 30.

Consequently, the firefighter's coat 10 has two common, fabric tapes 60, one on its left side from a wearer's standpoint and another on its right side from the wearer's standpoint, and two separate, fabric tapes 70, one on its left side from the wearer's standpoint and another on its right side from the wearer's standpoint, for a total of four fabric tapes, two tapes on each side from the wearer's standpoint. As compared to a firefighter's coat employing six fabric tapes, three tapes on each side from a wearer's standpoint, the firefighter's coat 10 is easier to fabricate and easier to repair and has fewer sewn seams, which may need to be sealed so as to be water-tight.

What is claimed is:

1. A combination comprising a closure zipper, which is useful for opening and closing an outer shell of a protective garment, and two liner zippers, which are useful, each on one side of the closure zipper, for attaching and detaching an inner liner for the protective garment, wherein each zipper has two rows of interengageable teeth, wherein, on each side of the closure zipper, a common, fabric tape having two opposite edges is provided, which is adapted to be attached to and within the outer shell, and one of the rows of interengageable teeth of the closure zipper and one of the rows of interengageable teeth of one of the liner zippers are provided along the opposite edges of the common, fabric tape, and wherein the other row of interengageable teeth of each of the liner zippers is attached to one edge of a separate, fabric tape, which is adapted to be attached to the inner liner.

2. The combination of claim 1, wherein the common, fabric tapes are adapted to be attached by being sewn to and within the outer shell and wherein the separate, fabric tapes are adapted to be attached by being sewn to the inner liner.

3. A protective garment comprising an outer shell, an inner liner, a closure zipper for opening and closing the outer shell, and two liner zippers, each on one side of the closure zipper, for attaching and detaching the inner liner, wherein each zipper has two rows of interengageable teeth, wherein, on each side of the closure zipper, a common, fabric tape having two opposite edges is provided, which is adapted to be attached to and within the outer shell, and one of the rows of interengageable teeth of the closure zipper and one of the rows of interengageable teeth of one of the liner zippers are provided along opposite edges of the common, fabric tape, and wherein the other row of interengageable teeth of each of the liner zippers is attached to one edge of a separate, fabric tape, which is attached to the inner liner.

4. The protective garment of claim 3, wherein the common, fabric tapes are attached by being sewn to and within the outer shell and wherein the separate, fabric tapes are attached by being sewn to the inner liner.

5. The protective garment of claim 3, which is a firefighter's coat.

6. The protective garment of claim 4, which is a firefighter's coat.

* * * * *